United States Patent [19]

Martin

[11] Patent Number: 4,655,390

[45] Date of Patent: Apr. 7, 1987

[54] MAILBOX SIGNAL DEVICE

[76] Inventor: Elbert T. Martin, 986 W. US 22, Maineville, Ohio 45039

[21] Appl. No.: 904,455

[22] Filed: Sep. 8, 1986

[51] Int. Cl.[4] ..... B65D 91/00

[52] U.S. Cl. ..... 232/35; 232/34

[58] Field of Search ..... 232/35, 34

[56] References Cited

U.S. PATENT DOCUMENTS

| | | | |
|---|---|---|---|
| 2,609,787 | 9/1952 | Lawson | 232/35 X |
| 2,808,982 | 10/1957 | Armstrong | 232/35 |
| 2,856,123 | 10/1958 | Mary | 232/35 |
| 3,709,189 | 1/1973 | Widham | 232/35 |
| 4,492,335 | 1/1985 | Davis | 232/35 |

*Primary Examiner*—Robert W. Gibson, Jr.

*Attorney, Agent, or Firm*—Charles R. Wilson

[57] ABSTRACT

A signal device for use on rural mailboxes comprises a substantially flat base and a lower flap. The flat base has a roof extending outwardly from the upper front surface and a protrusion, both of which aid in preventing the lower flap from freezing to the flat base under adverse weather conditions. The device is operational by gravity and is automatic. An adhesive is provided on the back surface of the flat base for ready installation of the device to existing mailboxes.

9 Claims, 4 Drawing Figures

MAILBOX SIGNAL DEVICE

This invention relates to a signal device for use on rural mailboxes. More particularly, the invention relates to a signal device which operates automatically upon opening of the mailbox door.

BACKGROUND OF THE INVENTION

Rural mailboxes are well known and are widely used. They are positioned alongside the rodeway so that mail can be placed in them by a mail carrier from his vehicle. Residents with rural mailboxes quite often do not know if mail has been delivered unless they happen to see the mail carrier at the instant the delivery is made. Obviously, this requires the resident to travel to the mailbox and physically inspect it. There has long been a need for a simple, yet convenient device which can effectively signal the mailbox user as to the delivery of mail. Several different mailbox signal devices have been devised. Examples of such signal devices can be found in U.S. Pat. Nos. 4,182,479; 4,363,439; 4,382,542; 4,492,335; 4,491,268. A common disadvantage with all of the known mailbox signal devices is that they are relatively complex and as such can easily break or readily become inoperable. Additionally, most are prone to not work in inclement weather conditions, especially freezing rains and snows.

There is still a need for an improved rural mailbox signal device. Such a device must be easy to install and easy to operate under a wide variety of weather conditions. Additionally, the device must be automatic in operation to be effective and acceptable.

SUMMARY OF THE INVENTION

A signal device adapted for use on a rural mailbox comprises a substantially flat base portion and a lower flap which is swingably attached to the flat base. The base has a roof extending outwardly from its upper front surface so as to protect the signal means from rain and snow when in a rest position. A protrusion extends from the front surface so as to prevent the lower flap from freezing to the flat base surface. Brackets extend from each side of the flap base's lower front surface for the purpose of having the lower flap attached thereto. The lower flap is capable of rotating about its attachment means so as to lean against the protrusion on the flat base when in a rest position and to hang vertically downward from the flat base when in a signalling position.

DETAILED DESCRIPTION

Figure 1:
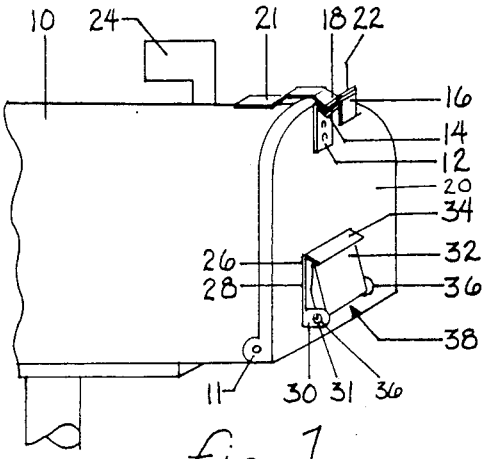
FIG. 1 is an illustration in perspective of a rural mailbox having the signal device of this invention attached thereto.
Figure 3:
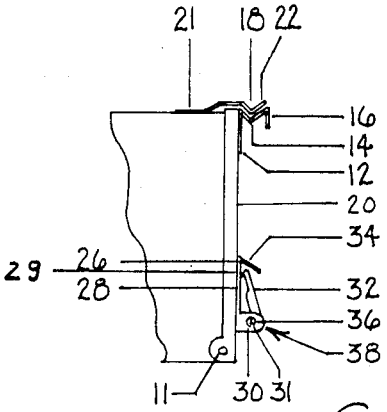
FIG. 3 is a side view of the mailbox and signal device of FIG. 1.
Figure 2:
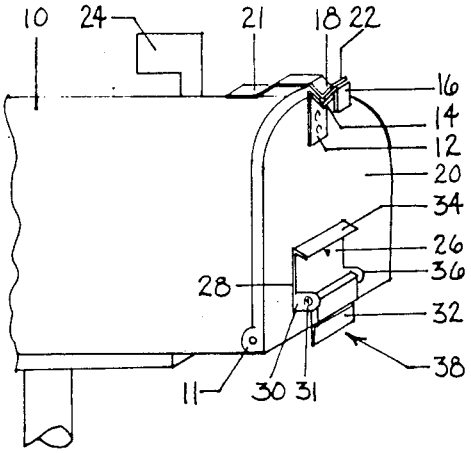
FIG. 2 is an illustration in perspective of the rural mailbox of FIG. 1 wherein the signal device is in a signalling position.

The signal device of this invention is intended for use on rural mailboxes. Such mailboxes are conventional and are widely used. With reference to FIGS. 1, 2 and 3, a typical rural mailbox comprises a housing 10 with a door 20 hingably attached by means 11 to the housing. A latch means 12 is positioned on the outside of the door and a mating keeper means 21 is attached on top of the housing. A detent 14 and pull means 16 causes the latch to engage and disengage keeper seat 18. Finger piece 22 aids in opening and closing of the door. The door is so constructed that it can be rotated about its hinges and latched by the keeper means in a semi-permanent closed position. Mail is placed in the housing simply by swinging the door open about its hinges, placing the mail within the housing and closing the door. Quite often a red flag 24 is positioned on the side of the mailbox as a means of signalling the mailman that mail to be picked up is within the mailbox. The mailbox is generally positioned about four feet off the ground on a post.

The signal device on this invention is adapted for ready attachment to the outside surface of the mailbox door. With reference to FIGS. 1–4, the signal device comprises a substantially flat base 26 having a roof portion 34 and brackets 30. The flat base is generally rectangular in shape with a length of about two inches to about five inches and a height of about one inch to about four inches. Additionally, the flat base has an adhesive means 28 positioned on its back surface for ready installation. The adhesive means preferably is a double-sided adhesive tape with a pealable protective surface paper on one side. For installation purposes, the pealable paper is merely removed by the user thereby exposing an adhesive surface. Positioning of the adhesive surface onto the mailbox is readily accomplished. The roof portion extending from the flat base is for the purpose of keeping rain and snow from contacting the upper portion of the base. Additionally, a protrusion 29 is positioned on the base. The purpose of the roof and the protrusion is to ensure that when the lower flap is in a rest position, the combination of the roof and protrusion will prevent said lower flap from being frozen to the back portion. This in effect would render the device inoperable. The roof portion extends from about one-fourth inch to about one inch outwardly from the flat base.

Brackets are provided on the lower portion of the flat base so as to hold a swingable lower flap. The brackets have holes 31 for receiving screws 36 which in turn are attached to the lower flap 32. The brackets extend a sufficient distance from the flat base that the lower flap is able to lean against the base in a stable rest position.

Lower flap 32 is dimensioned so as to fit within the confines of the brackets. The screws 36 attach the lower flap to the flat base which allows the lower flap to swing from a rest position up against the flat base to a signalling position extending downwardly from the flat base. Preferably, the lower flap is brightly colored on at least one surface so as to aid in its signalling function.

Figure 4:
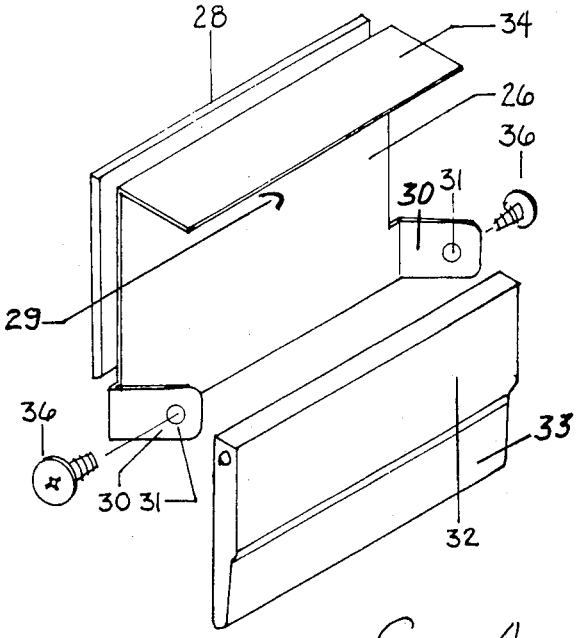
FIG. 4 is an exploded view of the signal device of this invention.

As apparent in FIG. 4, the top surface of the lower flap is preferably recessed. The recess 33 is provided to aid in the operation of the signal device. That is, by having the upper surface of the lower flap of lesser weight, it will more readily rest up against the flat base in a stable state and more readily swing down to a lower signalling position when the door of the mailbox is opened.

In operation, the signal device is mounted on the lower surface of the door of a mailbox. Initially, the lower flap is swung upwardly so as to rest against the flat base. In this position, the mailbox door is closed. Opening of the door so as to place mail within the mailbox causes the lower flap to swing about its axis. When the mailbox door is then closed and latched, the lower flap remains in its signalling position. The resident realizes upon mere observation that mail has been delivered. After retrieving the mail, the door is once again closed and the lower flap is flipped back up to its rest position.

While the invention has been described with particular reference to the figures, obvious variations and embodiments are within the scope of coverage.

What is claimed is:

1. A signal device for use on a rural mailbox having a housing open at one end and provided at said open end with a hinged door attached at a lower base of the housing so as to swing from a closed position downwardly to allow access to the interior of the housing, said signal device comprised of (i) a substantially flat base having a roof extending outwardly from the upper front surface of the flat base so as to protect the signal means from rain and snow when in a rest position, a protrusion extending from the front surface so as to prevent a lower flap from contacting the base's flat surface, brackets extending from each side of the flat base's lower front surface and adhesive attached to the flat base's back surface and (ii) lower flap swingably attached- to the brackets so that when the hinged door is in a closed position and the lower flap in a rest position, said lower flap is rotated about its attachment means so as to lean against the protrusion on the flat base and when in a signalling position is rotated about its attachment means so as to hang down in a vertical position.

2. The signal device of claim 1 wherein the lower flap is brightly colored for ready observation.

3. The signal device of claim 2 wherein an adhesive strip with a pealable protective surface paper is positioned on the flat base's back surface such that removal of the pealable protective surface paper exposes an adhesive surface adapted for attachment to the mailbox's hinged door.

4. The signal device of claim 2 wherein the protrusion on the flat base is centered.

5. The signal device of claim 2 wherein screw means are used for extending through each of the brackets and into the sides of the lower flap.

6. Ihe signal device of claim 2 wherein the lower flap is recessed along its top surface such that said recessed top surface contacts the protrusion when the signal device is in a rest position.

7. The signal device of claim 2 wherein the roof extends outwardly from the flat base about one-fourth inch to about one inch.

8. The signal device of claim 2 wherein the flat base is rectangular in shape and ranges from about two inches to about five inches in length and about one inch to about four inches in height.

9. The device of claim 2 wherein the brackets extend a sufficient distance from the flat base so as to allow the lower flap to be attached thereto and to lean against the flat base in a stable rest position.

* * * * *